US005117752A

United States Patent [19]

Micheli

[11] Patent Number: 5,117,752

[45] Date of Patent: Jun. 2, 1992

[54] ULTRASONIC INK SEAL FOR USE IN MULTICOLOR PRINTING PRESS

[75] Inventor: Paul R. Micheli, Glen Ellyn, Ill.

[73] Assignee: Rockwell International Corporation, El Segundo, Calif.

[21] Appl. No.: 693,113

[22] Filed: Apr. 25, 1991

[51] Int. Cl.[5] ..... B41F 31/06; B41F 31/08; B41L 27/08

[52] U.S. Cl. ..... 101/207; 101/211

[58] Field of Search ..... 101/350, 363, 364, 148, 101/207, 208-210, 483, 211; 310/313 R, 313 A, 335; 366/127, 600; 118/620, 639

[56] References Cited

U.S. PATENT DOCUMENTS 3,113,225 12/1960 Kleesattel et al. ..... 101/169

3,964,386 6/1976 Dini ..... 101/169

*Primary Examiner*—J. Reed Fisher

*Attorney, Agent, or Firm*—C. B. Patti; V. L. Sewell; H. F. Hamann

[57] ABSTRACT

An ultrasonic ink seal for use in a printing press having a metering roller (20) having an outer surface (40) and at least first and second devices (60, 62) for applying first and second inks, respectively, to the outer surface (40) of the metering roller (20). The ultrasonic ink seal has a plurality of piezoelectric transducers (91, 92, 93) and a deflecting device (96, 100, 102) for deflecting the ultrasonic sound waves produced by the piezoelectric transducers (91, 92, 93) toward a predetermined area (70) on the surface (40) of the metering roller (20). The ultrasonic sound waves cause the first and second inks to be forced away from the predetermined area (70) thereby providing a separation of the first and second inks. In a preferred embodiment the deflecting device (96, 100, 102) has a horn (96) having a curvature approximately equal to a curvature of the outer surface (40), of the metering roller (20), the horn (96) having at least first and second deflecting surfaces (97, 98). The deflecting device (96, 100, 102) also has first and second reflectors (100, 102) having first and second reflecting surfaces (104, 106), respectively, the first and second reflecting surfaces (104, 106) orientated toward the first and second deflecting surfaces (97,98) such that the ultrasonic sound waves that are deflected from the first and second deflecting surfaces (97, 98) are focused onto the predetermined area (70) of the surface (40) of the metering roller (20).

34 Claims, 7 Drawing Sheets

ULTRASONIC INK SEAL FOR USE IN MULTICOLOR PRINTING PRESS

BACKGROUND OF THE INVENTION

The present invention relates in general to ink or printing fluid input systems for use in a rotary printing press and, in particular, to an ink or printing fluid input system in which different ink colors are applied to a single metering roller.

In normal printing practice a single rotary plate cylinder is intended to print only a single ink color. For certain printing operations it is often desired to apply ink in two or more different colors to a single metering roller at different areas along the axial length of the metering roller. For that purpose, two or more ink or printing fluid input devices must be associated with the metering roller and must be separated from each other so that ink of different colors can be applied to the metering roller in the desired areas and so that smearing or mixing of the different colored inks will be avoided.

It is well known in the prior art to use different types of physical barriers between the ink input devices to insure that the different colored inks are kept separated. For example, it is known to use an ink separator plate that extends at right angles to the axis of the metering roller. Such an ink separator plate has a concavely curved end face having the same radius of curvature as that of the metering roller, and is brought into sealing contact with the surface of the metering roller. Also known is the use of sponge type materials in which water is circulated, these sponge type materials contacting the surface of the metering roller at a position for dividing one colored ink from another colored ink.

A drawback of the prior art is that these prior art seals of necessity form mechanical contact with the metering roller. These seals are difficult to set and require constant attention due to wear. Ink containment on anilox rolls used in flexographic and keyless printing press applications are also typically constructed using mechanical type seals which have these same drawbacks.

SUMMARY OF THE INVENTION

It is an object of the present invention to provide an improved ink seal for use in rotary printing presses, in which the seal does not contact the surface of the metering roller.

It is another object of the present invention to provide an ink seal which separates inks of two different colors applied to the surface of the metering roller utilizing ultrasonic sound waves.

In general terms, the present invention is an ultrasonic ink seal for use in a printing press having a metering roller having an outer surface and at least first and second means for applying first and second inks, respectively, to the outer surface of the metering roller. The ultrasonic seal has at least one means for producing ultrasonic sound waves and at least one means for deflecting the ultrasonic sound waves toward a predetermined area on the surface of the metering roller. The ultrasonic sound waves cause the first and second inks to be forced away from the predetermined area on the surface of the metering roller thereby providing a separation of the first and second inks. In a preferred embodiment the means for deflecting has a horn having a curvature approximately equal to a curvature of the surface of the metering roller. The horn has at least first and second deflecting surfaces. The means for deflecting also has first and second reflectors having at least first and second reflecting surfaces, respectively. The first and second reflecting surfaces are oriented toward the first and second deflecting surfaces such that the ultrasonic sound waves are deflected from the first and second deflecting surfaces to the first and second reflecting surfaces. The reflecting surfaces focus the ultrasonic sound waves onto the predetermined area of the surface of the metering roller. Each of the first and second reflectors has a curvature substantially equal to the curvature of the surface of the metering roller. In the preferred embodiment the horn has a triangular cross-sectional configuration and each of the first and second reflecting surfaces of the first and second reflectors, respectively, has a cross-sectional parabolic surface configuration. Also, in the preferred embodiment the means for providing ultrasonic sound waves is a plurality of piezoelectric transducers positioned adjacent the first and second deflecting surfaces of the horn. Also, the piezoelectric transducers are positioned to direct substantially equal values of ultrasonic sound waves onto each of the first and second deflecting surfaces of the horn.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
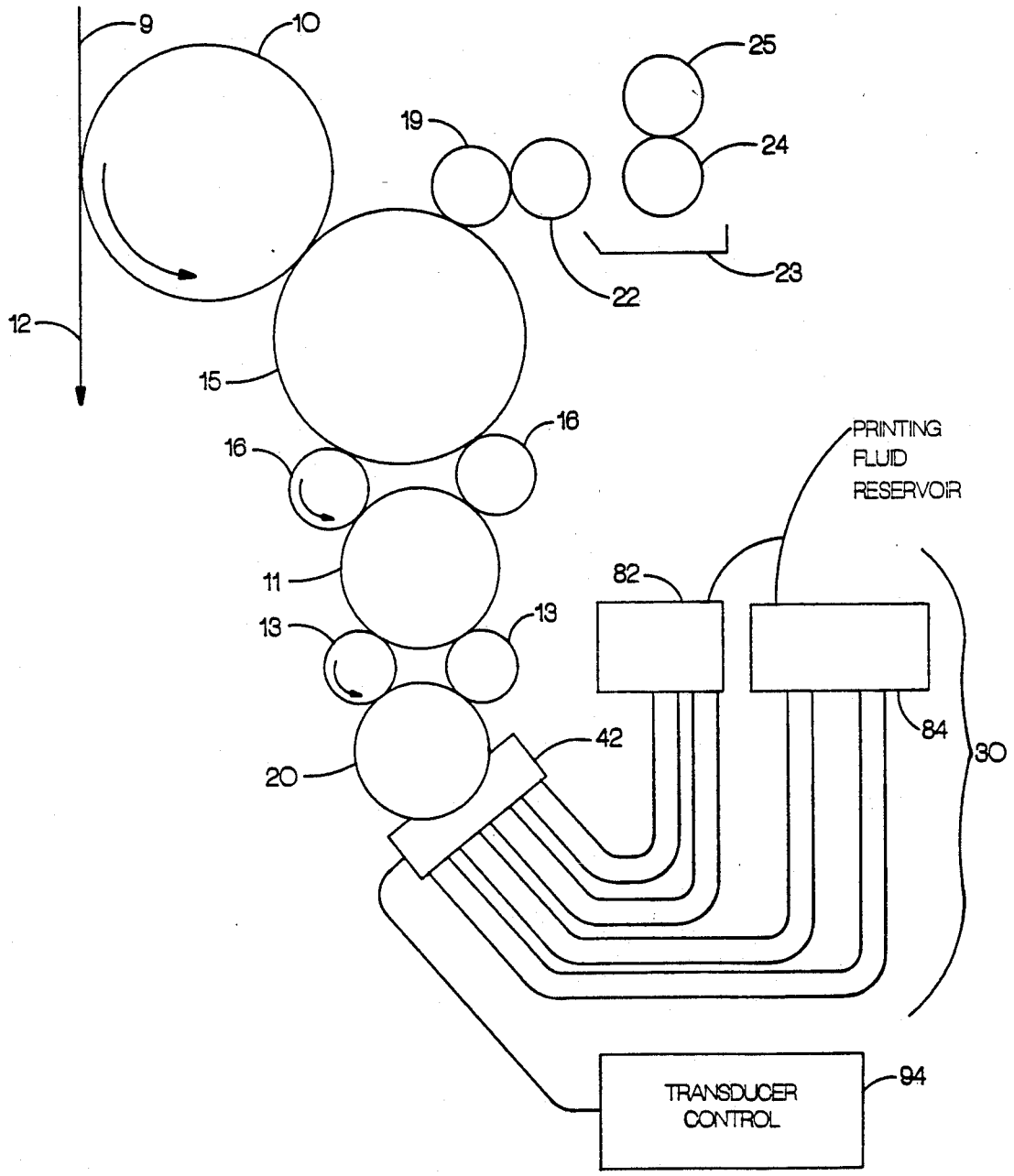
FIG. 1 is a schematic side view of a keyless lithographic printing press system in accordance with the present invention.

The present invention has general applicability that is most advantageously utilized in a rotary printing press as depicted in FIG. 1.

The rotary printing press depicted in FIG. 1 is a keyless inking system in which a blanket cylinder 10 prints on a web 9 traveling as indicated by the directional arrow 12. Referring first to the dampening and printing fluid input systems associated with blanket cylinder 10, a plate cylinder 15 is contacted by two form rollers 16 which are in turn contacted by a metering roller 20 via copper drum 11 and two transfer rollers 13. Although a smooth or moderately textured metering roller can be used with the present invention, the ink metering roller 20 may advantageously be of the type disclosed in U.S. Pat. Nos. 4,862,799, 4,882,990, 4,537,127, 4,567,827 or 4,601,242. In the dampening arrangement associated with plate cylinder 15 there typically is provided a rubber dampener form roller 19 and, for instance, a copper covered or a chrome covered oscillating transfer roller 22. Water or dampening solution is contained in a pan tray 23 and a pan roller 24 is used to pick up water from the pan 23 to bring it into contact with a spiral brush roller 25 that is rotating in a direction opposite to the direction of rotation of pan roller 24. It should be recognized that virtually any known dampening system can be used with this embodiment of the present invention.

With this or other arrangements dampening solution is transferred onto the transfer roller 22 and from there to the dampener form roller 19. In the FIG. 1 embodiment the form roller 19 is positioned in a water-first sequence so that, during each revolution of the press subsequent to transferring image-formulated printing fluid to the blanket cylinder 10, for transfer to the web 9, plates on the plate cylinder 15 are first subjected to dampening solution from the dampener form roller 19 before renewed ink or printing fluid is applied to the image surface of the plates by means of the rubber covered form rollers 16.

The printing fluid input system that is used to supply ink or printing fluid to the plate and blanket cylinders 15, 10, makes it possible to supply a uniform mixture of ink and naturally occurring dampening solution to the plate cylinder 15 and thereby maintain the high print quality characteristic of conventional lithography. In this arrangement the printing fluid source is identified generally by the numeral 30 and is used to deliver ink containing dampening solution, also referred to as the printing fluid, to the metering roller 20. Dampening solution in this system is not deliberately added to the ink in this embodiment, but rather results naturally from printing fluid comprised predominantly of ink coming in contact with dampening solution on the plate cylinder 15 and which, by means of the unused or return portion of printing fluid that passes or transfers back down through the various rollers, in part eventually enters the printing fluid input system 30.

The present invention can be used not only with the FIG. 1 printing press configuration, but also with most other keyless and non-keyless inking press configurations.

Figure 2:
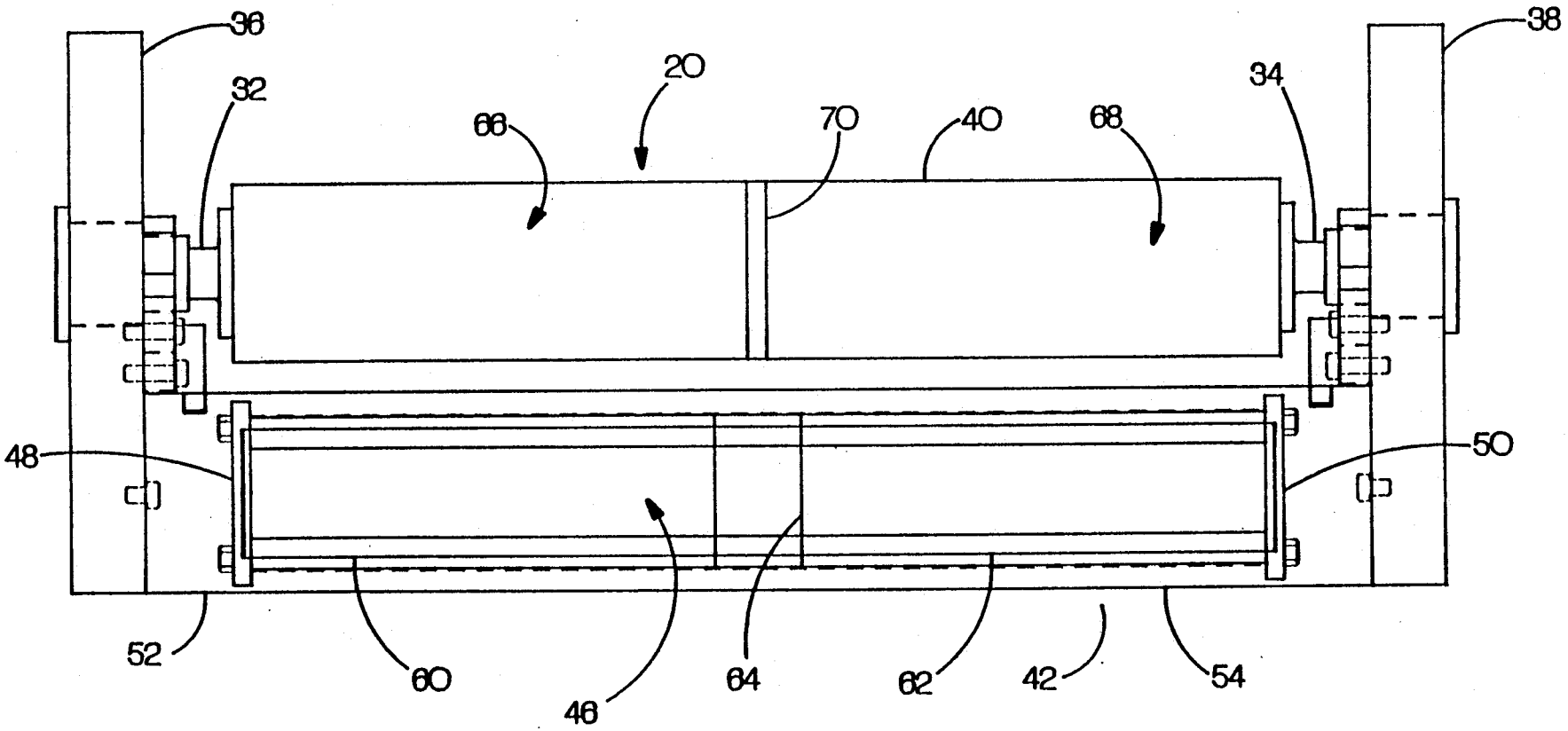
FIGS. 2 and 3 are plan and elevation views, respectively, of one embodiment of the ultrasonic ink seal of the present invention.
Figure 3:
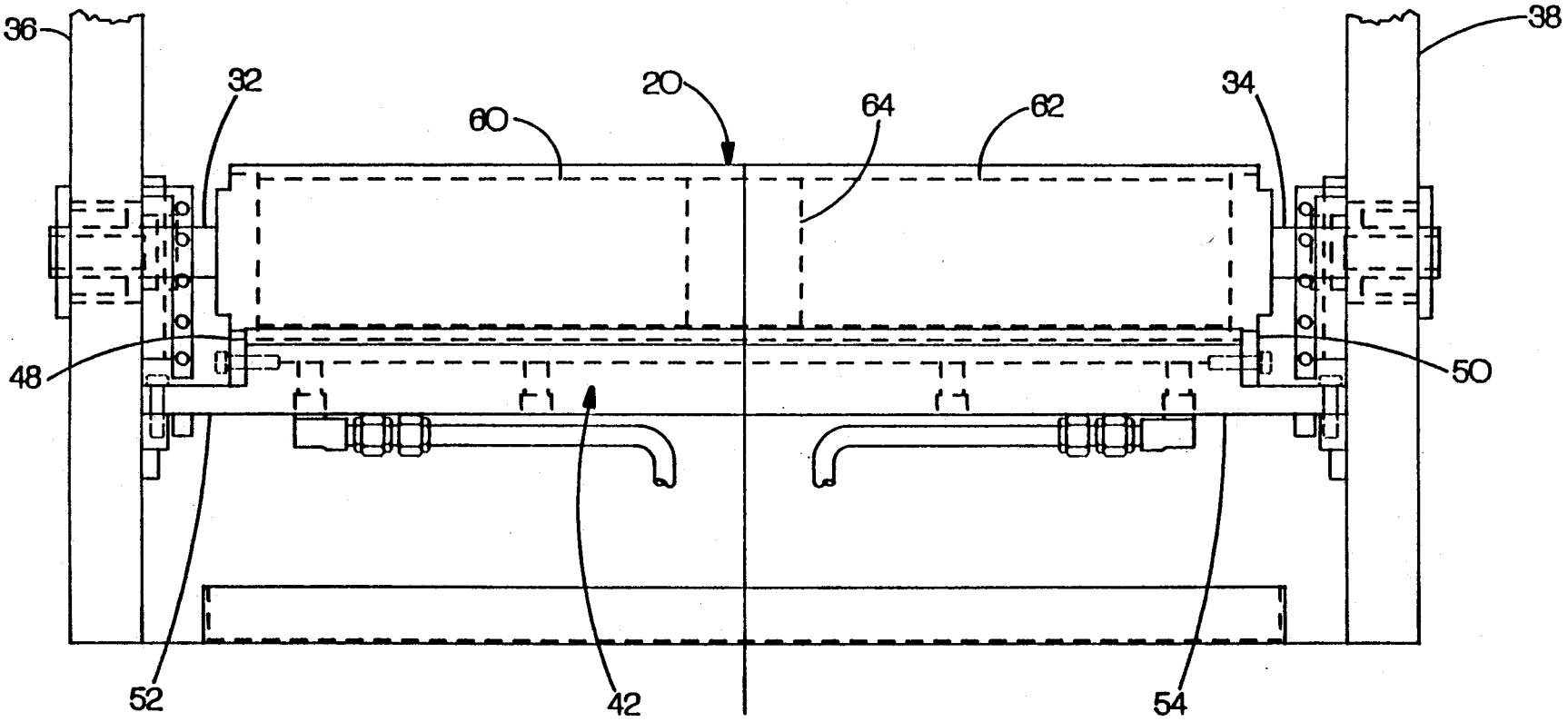
Figure 4:
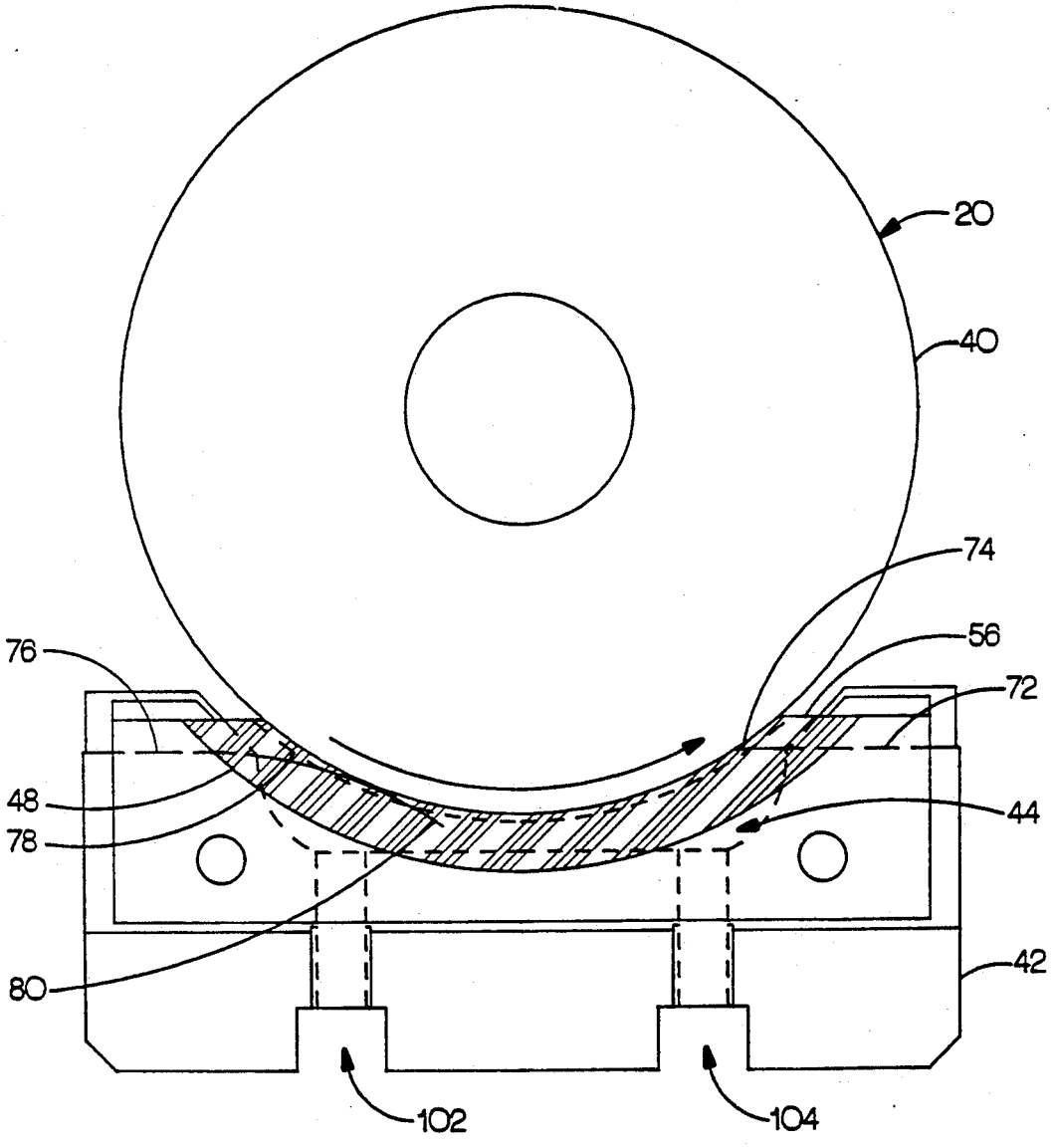
FIG. 4 is an end view of a printing fluid input apparatus depicted in FIGS. 2 and 3 and of the metering roller.

The printing fluid input apparatus 42 of the system 30 is depicted in an open servicing position relative to the metering roller 20 in FIG. 2 and in a closed operating position in FIG. 3. An end view of the printing fluid input apparatus 42 engaged with the metering roller 20 in a closed operating position is depicted in FIG. 4. The metering roller 20 has first and second ends 32 and 34 which rotate in frames 36 and 38, respectively. The metering roller 20 has a surface 40 intermediate the first and second ends 32 and 34, the surface 40 capable of retaining a quantity of printing fluid. The printing fluid input apparatus 42 has an open first side 46 which mates with at least a portion of the surface 40 of the metering roller 20. When the printing fluid input apparatus 42 is in the closed operating position a chamber 44 is formed which contains the printing fluid under a predetermined pressure.

In the embodiment depicted in FIGS. 1-3 first and second printing fluid input devices 60, 62 and the ultrasonic ink seal 64 form the printing fluid input apparatus 42. The first printing fluid input device 60 applies a first color ink to a first inking area 66 of the surface 40 of the metering roller 20, while the second printing fluid input device 62 simultaneously applies a second different color ink to a second inking area 68 of the surface 40 of the metering roller 20. The ultrasonic ink seal 64 of the present invention creates a narrow seal area 70 on the surface 40 such that the first and second inks are kept separated, as will be described in detail below.

At least first and second end seal assemblies 48 and 50 are mounted on first and second opposed ends 52 and 54, respectively, of the printing fluid input apparatus 42. Each of the first and second end seal assemblies 48 and 50 have at least a first surface 56 for mating with first and second end sections 58 and 60, respectively, of the metering roller 20 as depicted in FIG. 4. Prior art end seal assemblies 48 and 50 can be used with the present invention or they can be replaced by ultrasonic ink seals of the present invention. Thus, the novel ultrasonic ink seals can be used to contain ink at the ends of the metering roller 20, as well as, for providing a separation for two different inks.

Referring now also to FIG. 4, in each of the first and second printing fluid input devices 60, 62 a reverse angle doctor blade 72 has an edge 74 for applying a thin film of printing fluid to the surface 40 of the metering roller 20 by removing excess printing fluid adhering to the surface 40 as the metering roller 20 rotates past the printing fluid filled chamber 44. A sealing member 76 of the printing fluid input device 60, 62 has a surface area 78 for substantially sealing the chamber 44, at least the surface area 78 of the sealing member 76 being adjacent the surface 40 of the metering roller 20 such that an edge 80 of the sealing member 76 extends into the chamber 44. The sealing member 76 is substantially longer and more flexible than the reverse angle doctor blade 72.

The sealing member 76 may, for instance, be formed of steel or plastic and have a width in the range of approximately 1 to 2 inches and a thickness in the range of approximately 0.004 to 0.01 inch selected as a function of the open first side dimension of the printing fluid input apparatus 42 and of the diameter of the metering roller 20 which mates with the open first side, such that the sealing member 76 properly seals the chamber 44. The reverse angle doctor blade 72 may be formed of steel or plastic and in general have a width of approximately 1 inch and a thickness in the range of approximately 0.004 to 0.01 inch, if steel, and 0.04 to 0.06 inch, if plastic. Various other types and configurations of doctor and sealing blades can be used with the present invention.

The printing fluid input apparatus further includes for each of the printing fluid input devices 60, 62 at least one inlet means 102 for inputting ink or printing fluid into the chamber 44 and at least one outlet means 104 for outputting ink or printing fluid from the chamber 44. Since the chamber 44 is sealed by the metering roller 20, the first and second end assemblies 48 and 50, the reverse angle doctor blade 72 and the sealing member 76, it is thus possible to keep the printing fluid under a predetermined pressure. A circulating system can be used to pump the printing fluid from a respective printing fluid reservoir 82, 84 to the printing fluid input devices 60, 62.

Figure 5:
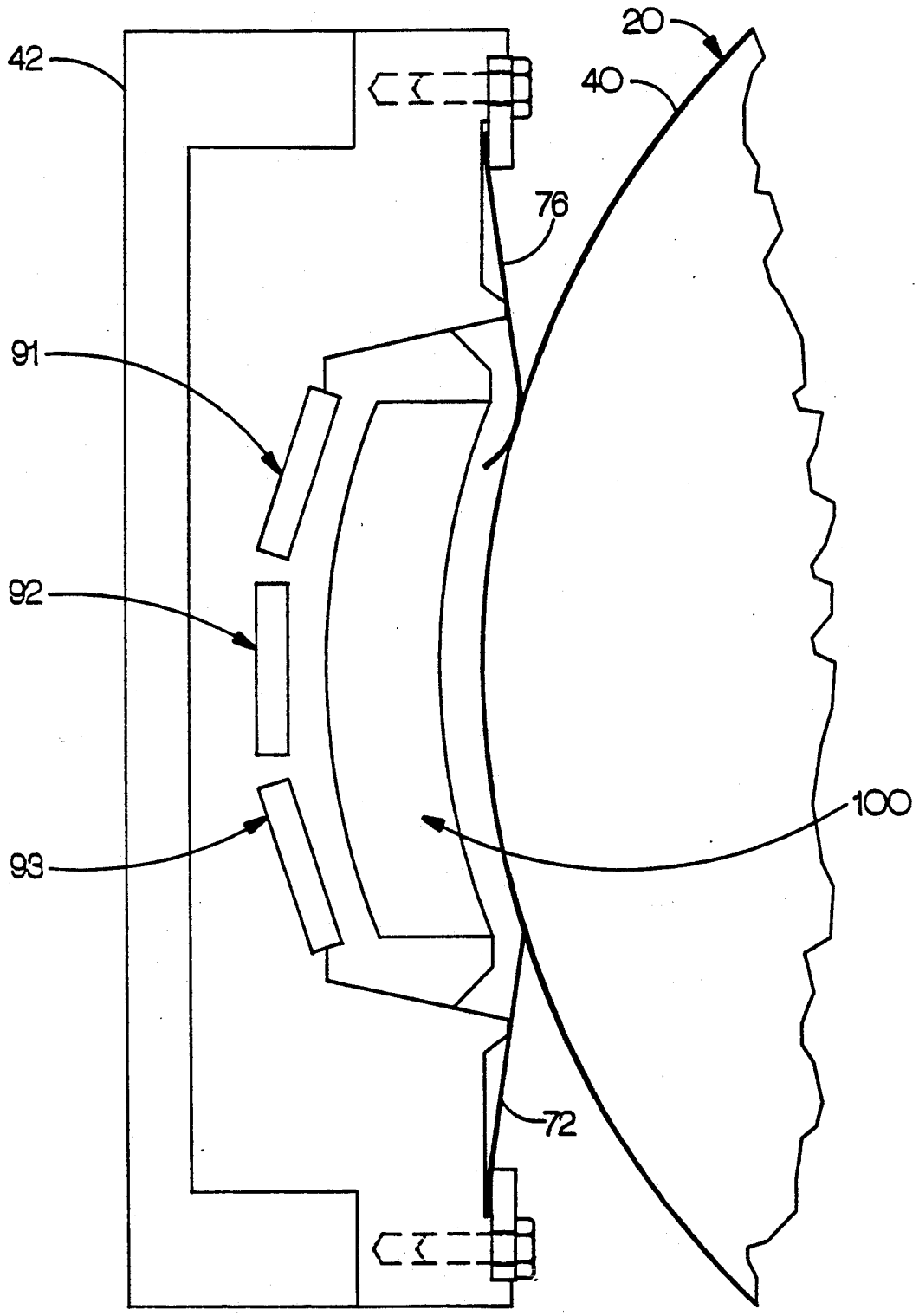
FIG. 5 is a cross-sectional view of the ultrasonic ink seal of the present invention incorporated in a printing fluid input apparatus for applying two different ink colors to the surface of the metering roller.
Figure 6:
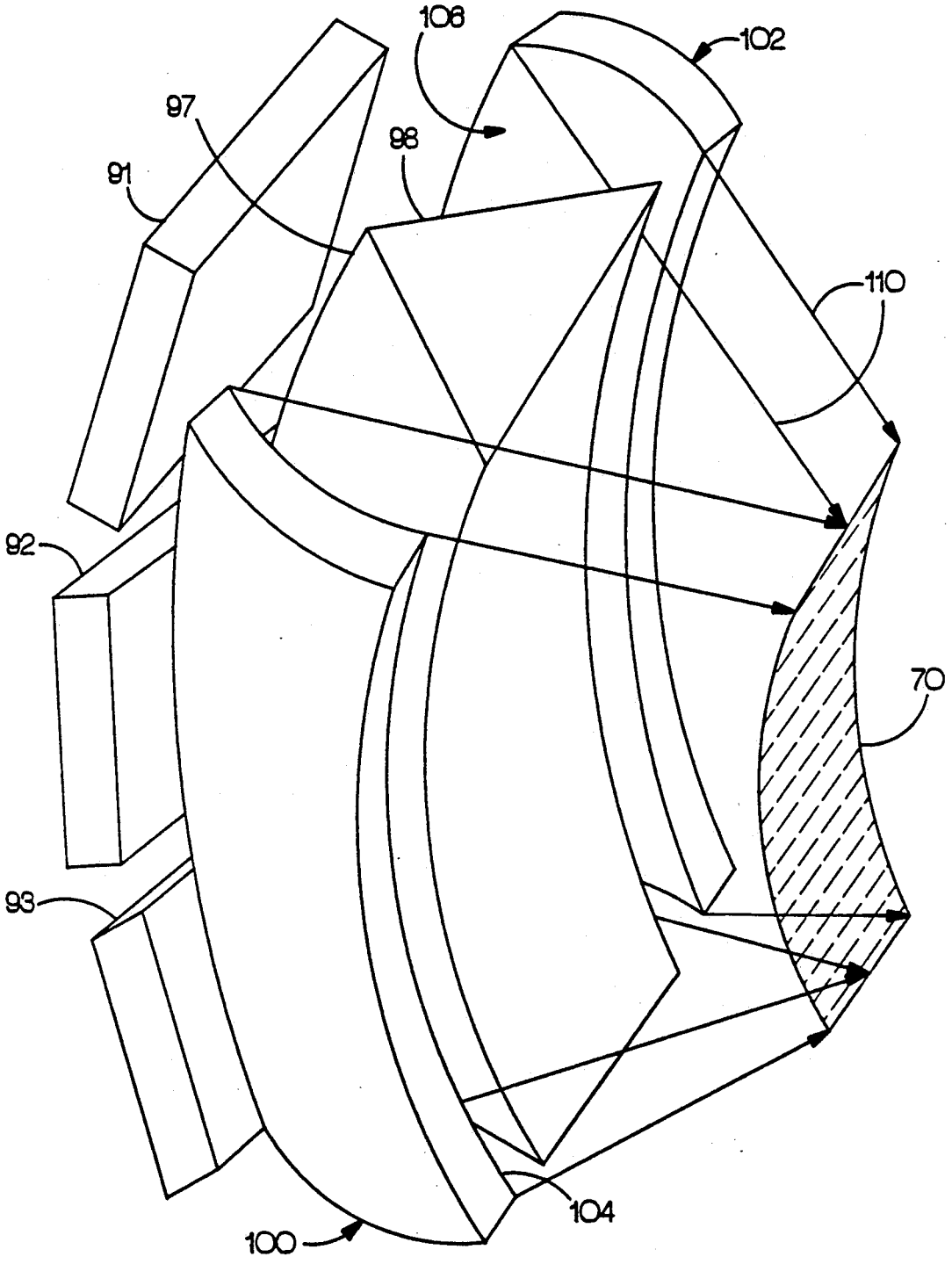
FIG. 6 is a perspective view of the ultrasonic ink seal of the present invention.
Figure 7:
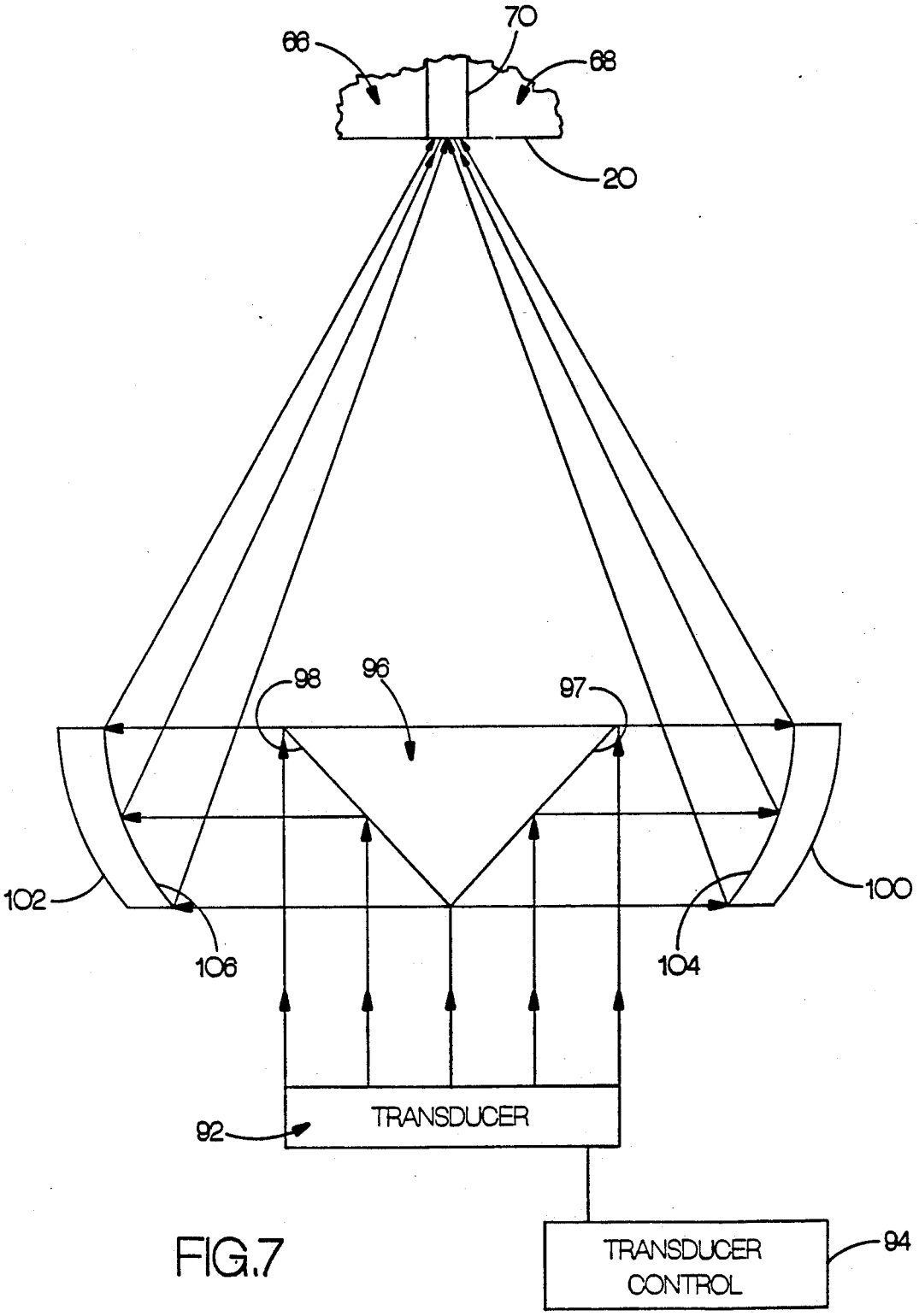
FIG. 7 is a cross-sectional view of the ultrasonic ink seal of the present invention depicting the path of ultrasonic sound waves.

The ultrasonic ink seal of the present invention is depicted in a cross-sectional view in the printing fluid input apparatus 42 in FIG. 5, is depicted in a perspective view in FIG. 6 and is depicted in another cross-sectional view in FIG. 7. In general terms, the ultrasonic ink seal has a means for producing ultrasonic sound waves and a means for deflecting the ultrasonic sound waves toward the predetermined area 70 on the surface 40 of the metering roller 20. The ultrasonic sound waves cause the first and second inks to be forced away from the predetermined area 70 on the surface 40 of the metering roller 20, thereby providing a separation of the first and second inks. In the preferred embodiment the means for producing ultrasonic sound waves has three piezoelectric transducers 91, 92, 93. These piezoelectric transducers 91, 92, 93 are controlled by a transducer control 94 and have an operating frequency of approximately 25 kilohertz in a preferred embodiment. A supply voltage of 24 v RMS is used to produce 0.0113 watts per square meter of ultrasonic energy.

The means for deflecting the ultrasonic sound waves emitted by the piezoelectric crystals has a horn 96 having a curvature approximately equal to a curvature of the surface 40 of the metering roller 20. The horn 96 has at least first and second deflecting surfaces 97, 98. The means for deflecting also has first and second reflectors 100, 102, having at least first and second reflecting surfaces 104, 106, respectively. The first and second reflecting surfaces 104, 106 are orientated toward the first and second deflecting surfaces 97, 98 such that the ultrasonic sound waves are deflected from the first and second deflecting surfaces 97, 98 to the first and second reflecting surfaces 104, 106. The first and second reflecting surfaces 104, 106 focus the ultrasonic sound waves onto the predetermined area 70 of the surface 40 of the metering roller 20. Also, in the preferred embodiment each of the first and second reflectors 100, 102 have a curvature substantially equal to the curvature of the surface 40 of the metering roller 20, as can be clearly seen in FIG. 6. Furthermore, in the preferred embodiment the piezoelectric transducers 91, 92, 93 are positioned to direct substantially equal values of ultrasonic sound waves onto each of the first and second deflecting surfaces 97, 98 of the horn 96.

The horn 96 has a triangular cross-sectional configuration and each of the first and second reflecting surfaces 104, 106 of the first and second reflectors 100, 102, respectively, has a cross-sectional parabolic surface configuration as can be clearly seen in FIG. 7. As shown in FIG. 7, the ultrasonic sound waves depicted by arrows 110 are focused onto the predetermined area 70 on the surface 40 of the metering roller 20. The ultrasonic inking seal of the present invention focusing the ultrasonic sound waves onto a predetermined area 70 is also shown in the FIG. 6 perspective view. However, it is to be understood that since the metering roller 20 is rotating during operation of the printing press, the resulting seal area extends completely around the surface 40 of the metering roller 20 and creates the separate first and second inking areas 66 and 68 on the surface 40. In the preferred embodiment, the predetermined area 70 formed by the ultrasonic ink seal of the present invention has a width of approximately one quarter inch and extends approximately 60° around a circumference of the surface 40 of the metering roller 20 (see FIG. 6).

It is to be pointed out that one skilled in the art would be able to adjust the power input to the piezoelectric crystals 91, 92, 93 to provide sufficient energy to the ultrasonic sound waves to prevent the first and second inks from forming on the predetermined area 70. Piezoelectric crystals including the operation and control thereof are well known in the prior art. Other operating frequencies for the ultrasonic sound waves can be used depending upon the application. Furthermore, frequencies of vibration outside of the normal ultrasonic frequency range could be utilized within the spirit of the present invention and devices suitable for imparting such frequencies of vibration could be used instead of piezoelectric transducers.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An ultrasonic ink seal for use in a printing press having a roller having an outer surface and at least first and second means for applying first and second inks, respectively, to the outer surface of the roller, comprising:

at least one means for producing ultrasonic sound waves;

at least one means for deflecting said ultrasonic sound waves toward a predetermined area on the surface of the roller;

said ultrasonic sound waves causing said first and second inks to be forced away from at least said predetermined area on the surface of the roller thereby providing a separation of said first and second inks.

2. An ultrasonic ink seal for use in a printing press according to claim 1, wherein said at least one means for producing ultrasonic sound waves is a piezoelectric transducer.

3. An ultrasonic ink seal for use in a printing press according to claim 2, wherein said piezoelectric transducer has an operating frequency of approximately 25 KHz.

4. An ultrasonic ink seal for use in a printing press according to claim 1, wherein said predetermined area has a width of approximately ¼ inch.

5. An ultrasonic ink seal for use in a printing press according to claim 1, wherein said predetermined area extends approximately 60° around a circumference of said surface of said roller.

6. An ultrasonic ink seal for use in a printing press according to claim 1, wherein said at least one means for deflecting has a horn having a curvature approximately equal to a curvature of said surface of said roller, said horn having at least first and second deflecting surfaces, said means for deflecting also having first and second reflectors having at least first and second reflecting surfaces, respectively, said first and second reflecting surfaces oriented toward said first and second deflecting surfaces such that said ultrasonic sound waves are deflected from said first and second deflecting surfaces to said first and second reflecting surfaces, the first and second reflecting surfaces focusing said ultrasonic sound waves onto said predetermined area of said surface of said roller.

7. An ultrasonic ink seal for use in a printing press according to claim 6, wherein each of said first and second reflectors has a curvature substantially equal to said curvature of said surface of said roller.

8. An ultrasonic ink seal for use in a printing press according to claim 6, wherein said at least one means for producing said ultrasonic sound waves has a plurality of piezoelectric transducers positioned adjacent said first and second deflecting surfaces of said horn.

9. An ultrasonic ink seal for use in a printing press according to claim 6, wherein said at least one means for producing said ultrasonic sound waves is positioned to direct substantially equal values of ultrasonic sound waves onto each of said first and second deflecting surfaces of said horn.

10. An ultrasonic ink seal for use in a printing press according to claim 6, wherein said horn has a triangular cross-sectional configuration.

11. An ultrasonic ink seal for use in a printing press according to claim 6, wherein each of said first and second reflecting surfaces of said first and second reflectors, respectively, has a cross-sectional parabolic surface configuration.

12. An ultrasonic ink seal for use in a printing press having a roller having an outer surface and at least first and second means for applying first and second inks, respectively, to the outer surface of the roller, comprising:

a plurality of piezoelectric transducers for producing ultrasonic sound waves;

at least one means for deflecting said ultrasonic sound waves toward at least a predetermined area on the surface of the roller;

said at least one means for deflecting having a horn having a curvature approximately equal to a curvature of said surface of said roller, said horn having at least first and second deflecting surfaces, said means for deflecting also having first and second reflectors having at least first and second reflecting surfaces, respectively, said first and second reflecting surfaces oriented toward said first and second deflecting surfaces such that said ultrasonic sound waves are deflected from said first and second deflecting surfaces to said first and second reflecting surfaces, the first and second reflecting surfaces focusing said ultrasonic sound waves onto said predetermined area of said surface of said roller;

said plurality of piezoelectric transducers positioned adjacent said first and second deflecting surfaces of said horn;

said ultrasonic sound waves causing said first and second inks to be forced away from said predetermined area on the surface of the roller thereby providing a separation of said first and second inks;

13. An ultrasonic ink seal for use in a printing press according to claim 12, wherein said piezoelectric transducer has an operating frequency of approximately 25 KHz.

14. An ultrasonic ink seal for use in a printing press according to claim 12, wherein said predetermined area has a width of approximately ¼ inch.

15. An ultrasonic ink seal for use in a printing press according to claim 12, wherein said predetermined area extends approximately 60° around a circumference of said surface of said roller.

16. An ultrasonic ink seal for use in a printing press according to claim 12, wherein said plurality of piezoelectric transducers are positioned to direct substantially equal values of ultrasonic sound waves onto each of said first and second deflecting surfaces of said horn.

17. An ultrasonic ink seal for use in a printing press according to claim 12, wherein said horn has a triangular cross-sectional configuration.

18. An ultrasonic ink seal for use in a printing press according to claim 12, wherein each of said first and second reflecting surfaces of said first and second reflectors, respectively, has a cross-sectional parabolic surface configuration.

19. A method for use in a printing press having a roller having a surface and for separating at least first and second inks applied by first and second means for applying the first and second inks, respectively, to different inking areas on the surface of the roller in the printing press, comprising the steps of:

producing ultrasonic sound waves; and deflecting said ultrasonic sound waves toward a predetermined area on the surface of the roller, said predetermined area being between said different inking areas on the surface of the roller, said ultrasonic sound waves causing said first and second inks to be forced away from said predetermined area on the surface of the roller thereby providing a separation of said first and second inks.

20. The method for use in a printing press according to claim 19, wherein said step of deflecting said ultrasonic sound waves comprises; directing said ultrasonic sound waves toward first and second deflecting surfaces to produce first and second deflected ultrasonic sound waves, and reflecting and focusing each of said first and second deflected ultrasonic sound waves onto said predetermined area.

21. The method for use in a printing press according to claim 19, wherein said predetermined area has a width of approximately ¼ inch.

22. The method for use in a printing press according to claim 19, wherein said predetermined area extends approximately 60° around a circumference of said surface of said roller.

23. The method for use in a printing press according to claim 19, wherein substantially equal values of ultrasonic sound waves are directed toward each of said first and second deflecting surfaces.

24. An ultrasonic ink seal for use in a printing press having a roller having an outer surface with first and second end areas and at least one means for applying ink to the outer surface of the roller, comprising:

at least one means for producing ultrasonic sound waves;

at least one means for deflecting said ultrasonic sound waves toward a predetermined area on the surface of the roller, said predetermined area being one of said first and second end areas of said outer surface of said roller;

said ultrasonic sound waves causing said ink to be forced away from at least said predetermined area on the surface of the roller thereby containing said ink on said outer surface of said roller.

25. An ultrasonic ink seal for use in a printing press according to claim 24, wherein said at least one means for producing ultrasonic sound waves is a piezoelectric transducer.

26. An ultrasonic ink seal for use in a printing press according to claim 25, wherein said piezoelectric transducer has an operating frequency of approximately 25 KHz.

27. An ultrasonic ink seal for use in a printing press according to claim 24, wherein said predetermined area has a width of approximately ¼ inch.

28. An ultrasonic ink seal for use in a printing press according to claim 24, wherein said predetermined area extends approximately 60° around a circumference of said surface of said roller.

29. An ultrasonic ink seal for use in a printing press according to claim 24, wherein said at least one means for deflecting has a horn having a curvature approximately equal to a curvature of said surface of said roller, said horn having at least first and second deflecting surfaces, said means for deflecting also having first and second reflectors having at least first and second reflecting surfaces, respectively, said first and second reflecting surfaces oriented toward said first and second deflecting surfaces such that said ultrasonic sound waves are deflected from said first and second deflecting surfaces to said first and second reflecting surfaces, the first and second reflecting surfaces focusing said ultrasonic sound waves onto said predetermined are of said surface of said roller.

30. An ultrasonic ink seal for use in a printing press according to claim 29, wherein each of said first and second reflectors has a curvature substantially equal to said curvature of said surface of said roller.

31. An ultrasonic ink seal for use in a printing press according to claim 29, wherein said at least one means for producing said ultrasonic sound waves has a plurality of piezoelectric transducers positioned adjacent said first and second deflecting surfaces of said horn.

32. An ultrasonic ink seal for use in a printing press according to claim 29, wherein said at least one means for producing said ultrasonic sound waves is positioned to direct substantially equal values of ultrasonic sound waves onto each of said first and second deflecting surfaces of said horn.

33. An ultrasonic ink seal for use in a printing press according to claim 29, wherein said horn has a triangular cross-sectional configuration.

34. An ultrasonic ink seal for use in a printing press according to claim 29, wherein each of said first and second reflecting surfaces of said first and second reflectors, respectively, has a cross-sectional parabolic surface configuration.

* * * * *